US010215185B2

(12) United States Patent
Felix et al.

(10) Patent No.: US 10,215,185 B2
(45) Date of Patent: Feb. 26, 2019

(54) PUMP FOR THE CONVEYANCE OF A FLUID WITH VARYING VISCOSITY

(71) Applicant: Sulzer Management AG, Winterthur (CH)

(72) Inventors: Thomas Felix, Zumikon (CH); Simon Gassmann, Zürich (CH); Thomas Welschinger, Radolfzell (DE)

(73) Assignee: SULZER MANAGEMENT AG, Winterthur (CH)

( * ) Notice: Subject to any disclaimer, the term of this patent is extended or adjusted under 35 U.S.C. 154(b) by 427 days.

(21) Appl. No.: 15/190,617

(22) Filed: Jun. 23, 2016

(65) Prior Publication Data

US 2017/0022997 A1 Jan. 26, 2017

(30) Foreign Application Priority Data

Jul. 23, 2015 (EP) ..... 15178068

(51) Int. Cl.
*F04D 29/041* (2006.01)
*F04D 7/04* (2006.01)
(Continued)

(52) U.S. Cl.
CPC ..... *F04D 29/041* (2013.01); *E21B 43/121* (2013.01); *F04D 1/06* (2013.01);
(Continued)

(58) Field of Classification Search
CPC .. F04D 29/041; F04D 29/0416; F04D 29/051; F04D 29/0516
(Continued)

(56) References Cited

U.S. PATENT DOCUMENTS 4,121,839 A * 10/1978 Takano ..... F04D 1/066 277/319
4,725,196 A * 2/1988 Kaneki ..... F04D 29/104 415/100
5,540,546 A * 7/1996 Bouricet ..... F01D 3/04 415/104
9,938,983 B2 * 4/2018 Stalder ..... F04D 29/0516
(Continued)

FOREIGN PATENT DOCUMENTS

DE 249336 C 7/1912
DE 4313455 A1 10/1994
(Continued)

OTHER PUBLICATIONS

Full English translation of DE 249336, original document dated Jul. 16, 1912.*
(Continued)

*Primary Examiner* — Jason Shanske
*Assistant Examiner* — Topaz L Elliott
(74) *Attorney, Agent, or Firm* — Global IP Counselors, LLP

(57) ABSTRACT

A pump includes a housing having an inlet and an outlet configured to convey fluid, an impeller configured to convey the fluid from the inlet to the outlet, the impeller being arranged on a rotatable shaft, and a balance drum configured to relieve axial thrust. The balance drum includes a rotor rotationally fixedly connected to the shaft, the rotor having a high and low pressure sides, a stator stationary with respect to the housing, a relief passage extending between the rotor and the stator from the high pressure side up to the low pressure side of the rotor, a return passage connecting the low pressure side of the rotor to the inlet. An intermediate passage opens into the relief passage between the high pressure side and the low pressure side of the rotor. A blocking member is configured to influence the flow through the intermediate passage.

16 Claims, 10 Drawing Sheets

(51) Int. Cl.

| | |
|---|---|
| ***F04D 29/42*** | (2006.01) |
| ***E21B 43/12*** | (2006.01) |
| ***F04D 1/06*** | (2006.01) |
| ***E21B 43/20*** | (2006.01) |
| ***F04D 13/08*** | (2006.01) |
| ***F04D 31/00*** | (2006.01) |
| *F04D 29/051* | (2006.01) |

(52) U.S. Cl.
CPC ..... *F04D 7/045* (2013.01); *F04D 29/0416* (2013.01); *F04D 29/4293* (2013.01); *E21B 43/20* (2013.01); *F04D 7/04* (2013.01); *F04D 13/08* (2013.01); *F04D 29/0516* (2013.01); *F04D 31/00* (2013.01)

(58) Field of Classification Search
USPC ..... 415/104, 105, 106
See application file for complete search history.

(56) References Cited

U.S. PATENT DOCUMENTS

2013/0115042 A1* 5/2013 Mariotti ..... F04D 29/0516 415/1

FOREIGN PATENT DOCUMENTS

| | | | |
|---|---|---|---|
| JP | 01237394 | A | 9/1989 |
| WO | 2009135802 | A1 | 11/2009 |

OTHER PUBLICATIONS

Extended European Search Report dated Feb. 2, 2016 in EP Patent Application No. 15178068.1, filed Jul. 23, 2015 (with English Translation of Categories of Cited Documents).

* cited by examiner 1
15
13
8
10
9
9
6
61
63
62
5
4
A
A
3
2
E
D

PUMP FOR THE CONVEYANCE OF A FLUID WITH VARYING VISCOSITY

CROSS-REFERENCE TO RELATED APPLICATIONS

This application claims priority to EP Application No. 15178068.1, filed Jul. 23, 2015, the contents of which is hereby incorporated herein by reference.

BACKGROUND

Field of the Invention

The invention relates to a pump for the conveyance of a fluid with varying viscosity.

Background of the Invention

Frequently very large hydraulic forces are generated in single-stage or multi-stage centrifugal pumps that act in the axial direction, this means in the direction of the longitudinal axis of the shaft of the pump. These forces must be absorbed by the axial bearings of the shaft. However, as these axial bearings have to be made as small as possible for practical and technical reasons it is a well-known measure to provide a balance drum for the compensation of axial thrust acting on the shaft of the pump. This comprises a rotor, typically a substantially cylindrical rotor, rotationally fixedly connected with the shaft and a stator arranged coaxially thereto that is stationary with respect to the pump housing. In this connection the stator can, for example, be configured as a separate sleeve or also be formed by the housing itself. The rotor is dimensioned in such a way that a narrow, ring-shaped relief gap is formed between the rotor and the stator. This, on the high pressure side, is connected to the space behind the impeller and/or having regard to multi-stage pumps to the space behind the last impeller, in such a way that a leakage flow of the conveyed fluid can flow through the relief gap to the low pressure side of the rotor. From there, the fluid is resupplied to the inlet of the pump. Due to the pressure decrease across the rotor, a force is generated in this way in the axial direction which is directed opposite to the hydraulic axial forces generated by the impeller and therefore considerably reduces the forces to be absorbed by the axial bearings.

SUMMARY

Having regard to the design of the balance drum, a very important role is given to the geometric dimensions, in particular to the diameter and the axial length of the rotor and to the clearance between the rotor and the stator which determines the width of the relief passage in the radial direction.

The leakage flow through the relief passage causes a volume loss of the conveyed fluid that should naturally be maintained as small as possible, wherein the leakage flow, on the other hand, must also be so large that the desired technical effects are realized. As a further effect—and this in particular true having regard to highly viscous fluids—the fluid flow in the relief passage causes a friction that can lead to a considerable and non-desired temperature increase in the relief passage.

In addition to the function of the relief of axial thrust, the fluid flowing through the relief passage can also contribute to the stabilization and/or the stability of the pump rotor dynamics. Through the effect known as the Lomakin effect, the fluid flowing in the relief passage generates forces centering the shaft which have a positive influence both with regard to the damping of the shaft bearing and also with regard to the stiffness of the shaft bearing.

Further important parameters that have to be considered with respect to the design of the balance drum are the speed of rotation with which the pump is operated, the generated pressure difference, the density of the fluid and the internal friction, this means the viscosity of the conveyed fluid.

Having regard to the design of the pump hydraulics one strives to realize an as ideal as possible compromise between all these effects, with the fluid properties generally not being able to be influenced and also not being sufficiently known and for this reason only being capable of being estimated.

Numerous applications exist in which the properties of the fluid to be conveyed are not constant, but can rather vary more or less fast.

By multi-phase pumps, for example, fluids are conveyed that include a mixture of a plurality of phases, for example, one or more liquid phases and one or more gaseous phases. Such pumps have been well known for a long time and are produced in numerous designs. The field of application of these pumps is very broad, for example, they are used in the oil and gas industry for the conveyance or transport of crude oil or crude oil natural gas mixtures. In this respect the fluid properties can vary over time, e.g. the phase composition and/or the phase distribution of the multi-phase fluid to be conveyed can vary. The relative volume portions of the liquid phase and of the gaseous phase—for example having regard to the conveyance of oil—are subjected to very large fluctuations which, amongst other things, is due to the natural source.

Particularly having regard to the conveyance of crude oil and/or of natural gas, also very stark changes in the viscosity of the fluid can even arise, which will be explained in the following with reference to an example. Having regard to the exploitation and/or the extraction of oil fields, the naturally present pressure in an oil field decreases over time—this means with an increase of extraction. It is a known technology to press water into the oil field by so-called injection pumps for a decrease of the natural pressure in the oil field to thus increase the pressure at the bore hole. However, this has the consequence that the pump, by which the oil is conveyed from the bore hole, is faced with a fluid of varying viscosity and/or internal friction for the duration of the extraction. At the start of the extraction it is in most cases the natural oil or oil-gas-mixture that is conveyed. With an increase in the introduction of water into the oil field the fluid changes at some point in time to a water-oil-emulsion that has a significantly higher internal friction that can be orders of magnitude larger than that of the initially conveyed crude oil. With a further extraction the water portion in the conveyed fluid then becomes so large that a stark decrease of the viscosity is brought about again.

This significantly pronounced maximum that, having regard to the extraction of an oil field in a timely progression of the viscosity—is frequently only present after a few years—at times makes it necessary to replace the pumps with which the oil is conveyed out of the bore hole or is transported through the pipelines, or to at least replace its hydraulics. This is naturally not desired by the operator of the oil conveyor also for economic reasons, he rather has the desire that the pumps used for the conveyance of the crude oil/natural gas should be efficiently operatable over the entire period of time for the extraction of the oil field if possible, without an exchange of the pump or an exchange of the high pump hydraulics.

This is in particular true for such applications in which the pumps are only accessible in a difficult manner or with a considerable demand in effort and cost. In this connection sub-sea applications should be mentioned as an example. Today oil fields are also extracted to an increasing degree that are present beneath the floor of the sea and that cannot be reached with the classical drilling platforms at all or in a non-economically viable manner. For this reason one has started to place parts of the conveying equipment, such as, for example, pumps, on the floor of the sea in the vicinity of the exit of the bore hole. From there the conveyed oil is then transported to processing units or storage units that are provided on land, on a drilling platform or on a ship as a FPSO (Floating Production Storage and Offloading Unit). Precisely in such cases in which the pump is configured as a sub-sea pump for the operation on the floor of the sea it is naturally desirable to have a pump made available that can efficiently and economically convey also fluids with a strongly changing viscosity without an exchange, for example of the pump hydraulics becoming necessary.

A possible solution is given by the provision of a settable valve in the return line by means of which the fluid flowing through the relief passage from the low pressure side of the rotor of the balance drum is resupplied to the inlet of the pump in order to thus restrict the resupply more or less strongly. In this way one can at least in principle also influence the flow through the relief gap between the rotor and the stator. A restriction in the return line can, however, lead to a considerable reduction of the compensation of axial thrust generated by the balance drum, as the pressure decrease becomes significantly smaller across the balance drum. This however means that the hydraulic thrust forces to be absorbed by the axial bearings of the shaft become larger for which these have to be designed, as otherwise the danger exists that the axial bearings become overloaded or are subjected to a significant increase in wear.

For this reason, it is an object of the invention to make available a pump that is suitable for the efficient and economic conveyance of fluids with starkly varying viscosity, without an exchange of the pump hydraulics, this means of the impeller or the impellers and/or of the balance drum having to be carried out.

The subject matter of the invention satisfying this object is characterized by the features of the independent patent claim.

In accordance with the invention a pump for the conveyance of a fluid with varying viscosity is thus suggested which has a housing having an inlet and having an outlet for the fluid to be conveyed, as well as having at least one impeller for the conveyance of the fluid from the inlet to the outlet which is arranged on a rotatable shaft, as well as having a balance drum for the relief of axial thrust; wherein the balance drum comprises a rotor rotationally fixedly connected to the shaft, the rotor having a high pressure side and a low pressure side, a stator stationary with respect to the housing and a relief passage that extends between the rotor and the stator from the high pressure side to the low pressure side of the rotor; and wherein a return passage is further provided which connects the low pressure side of the rotor to the inlet, wherein at least one intermediate passage is provided which opens into the relief passage between the high pressure side and the low pressure side of the rotor and wherein a blocking member is provided for the influencing of the flow through the intermediate passage.

The length of the relief passage can be changed through the intermediate passage and the blocking member and in this way also the effective length of the rotor of the balance drum can be changed. As, as has already been mentioned, the diameter of the length of the rotor of the balance drum has a decisive influence both with regard to the flow rate through the balance drum and also with regard to the temperature increase caused by friction in the relief passage, an adaptation with respect to strong changes in the viscosity of the fluid can in this way take place in a very simple manner through the provision of the intermediate passage. Functionally one namely now quasi has the option of operating the pump with at least two different balance drums of different length. For a comparatively low viscosity of the fluid—this means, for example at the start of the extraction of an oil field when essentially only oil and/or an oil-gas-mixture is conveyed—the intermediate passage can be blocked off by the blocking member, such that the leakage flow is guided over the complete length of the balance drum up to the low pressure side of the rotor and from there can be conducted away again through the return passage. If a strong increase in the viscosity is brought about—this means, for example, to the described peak in the internal friction of the fluid that is based on the formation of the oil-water-emulsion—then the blocking member and in this way the intermediate passage is completely opened such that now the leakage flow can be conducted away essentially completely from the relief passage into the intermediate passage. As in this way the effective length, this means the part of the relief passage flown through is shortened, the temperature increase generated by means of friction in the relief gap is also significantly reduced. This is proportional to the ratio of friction to leakage rate. In this way the pump and, in particular the balance drum, can be adapted in a simple manner also with respect to strong changes in the viscosity of the fluid. In this connection it is particularly advantageous that the relief of axial thrust generated by the balance drum, if at all, does not substantially experience a reduction, such that no larger loads have to be absorbed by the axial bearing of the shaft.

Preferably the relief passage comprises a ring space which surrounds the shaft and into which the intermediate passage opens. Hereby it is ensured that the fluid can flow away particularly well and uniformly from the relief passage into the intermediate passage for an open intermediate passage.

In accordance with a preferred embodiment the relief passage has a constant width in a radial direction outside of the ring space. The relief passage is divided by the intermediate passage into a first part passage and into a second part passage that are arranged behind one another in the axial direction. Preferably, the relief passage has a constant width in the radial direction outside of the ring space in the first part passage or in the second part passage—particularly preferably in both part passages. In this connection the width of the first part passage can be just as large as the width of the second passage or the first part passage and the second part passage can have different widths. Due to the different widths of the two part passages the leakage rate through the relief passage can be increased or decreased in a simple manner.

Preferably the intermediate passage is connected to the inlet such that the fluid flowing out via the intermediate passage can be resupplied to the inlet of the pump.

In a preferred embodiment the intermediate passage opens into the return passage as hereby the constructive design becomes more simple.

An advantageous measure consists therein that the blocking member is configured as a settable through-flow valve. In this way the flow in the intermediate passage can be set also to values between zero and the maximum flow.

Also, depending on the application, it can be advantageous when a second blocking member is provided for the influencing of the flow through the return passage. In this way the flow rate can also be actively influenced in the return passage.

In accordance with a preferred embodiment the blocking member is configured as a three-way valve which is connected to the inlet, to the return passage and to the intermediate passage in a flow communicating manner. By this measure the return passage or the intermediate passage can selectively be connected to the inlet of the pump in a flow communicating manner in a particularly simple way from an apparatus point of view.

Having regard to a likewise preferred design, a switching member is provided by means of which the return passage can be selectively connected to the inlet of the pump or to a source for a second fluid, such that the second fluid can be supplied through the return passage to the low pressure side of the rotor. In this way it is, for example, possible to supply a second fluid through the return passage that can, for example, serve as a blocking liquid.

It is naturally also possible that the blocking member is arranged and configured in such a way that the intermediate passage can be connected to a source for a second fluid, such that the second fluid can be introduced into the relief passage through the intermediate passage. The second fluid can, e.g. be a demulsifier with which the viscosity of the fluid can be reduced in the relief gap. Also this is a possibility of introducing a second fluid into the relief passage in order to reduce the viscosity of the fluid in this connection.

Depending on the application it can also be advantageous when a plurality of intermediate passages is provided of which each opens into the relief passage between the high pressure side and the low pressure side. By this measure even more different lengths of the relief passages can be realized.

In particular having regard to applications at positions difficult to access—for example at the floor of the sea, it is an advantageous measure when the blocking member or the second blocking member or the switching member can be operated by remote control. For this, these members can, for example be configured as electrically or hydraulically actuatable members or electric-hydraulically actuatable members which then, for example, can be remote controlled via a signal line or, depending on the application, can also be remote controlled in a wireless manner.

The pump in accordance with the invention can, in particular be configured as a multi-stage pump that has at least one second impeller arranged on the shaft for the conveyance of the fluid.

It is also possible to configure the pump in accordance with the invention as a multi-phase pump.

Particularly preferably the pump in accordance with the invention can also be configured as a centrifugal pump for the conveyance of oil and gas, in particular as a sub-sea pump for the sub-sea conveyance of oil and gas.

Further advantageous measures and designs of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
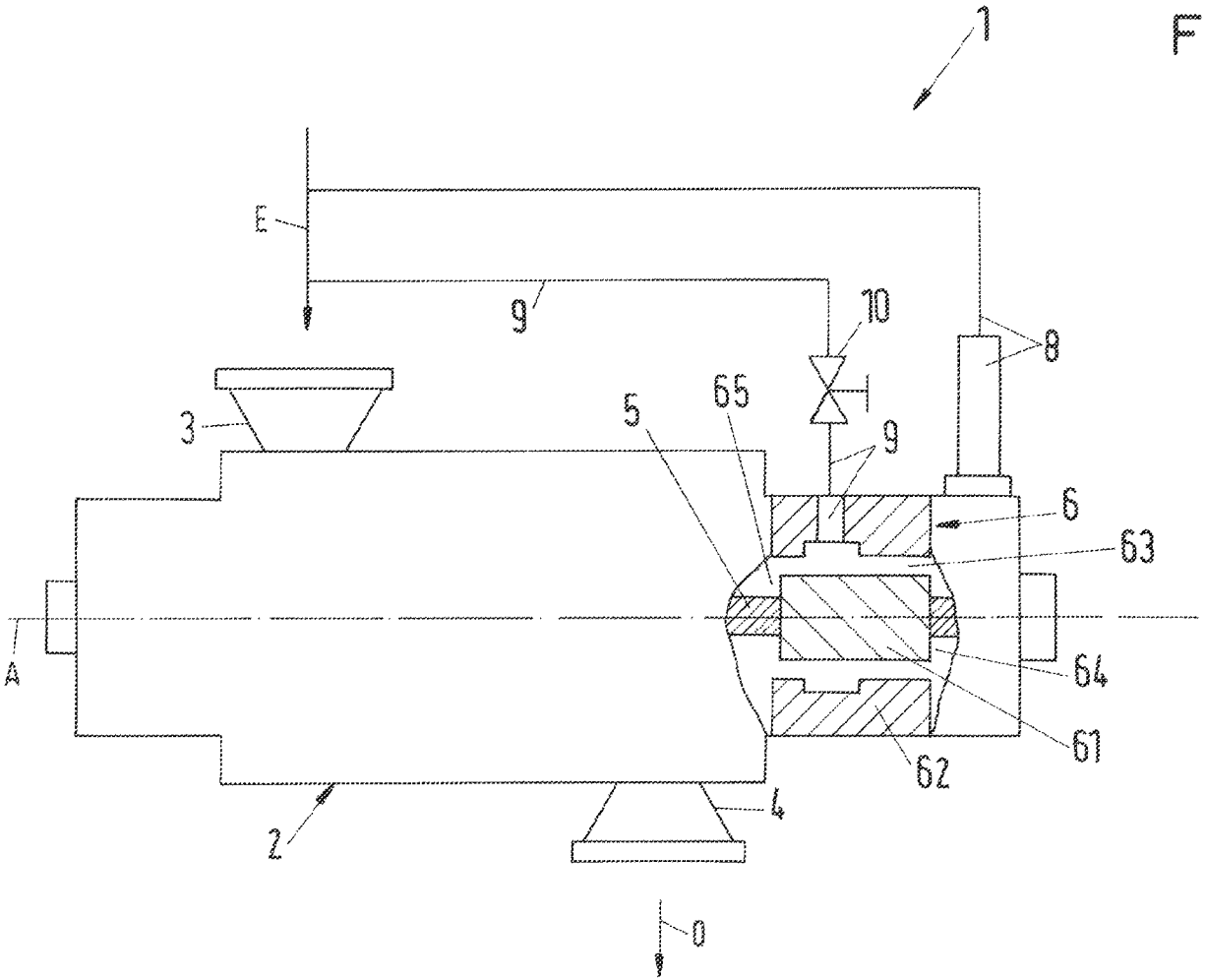
FIG. 1 is a schematic illustration of a first embodiment of a pump in accordance with the invention with an outcrop.
Figure 2:
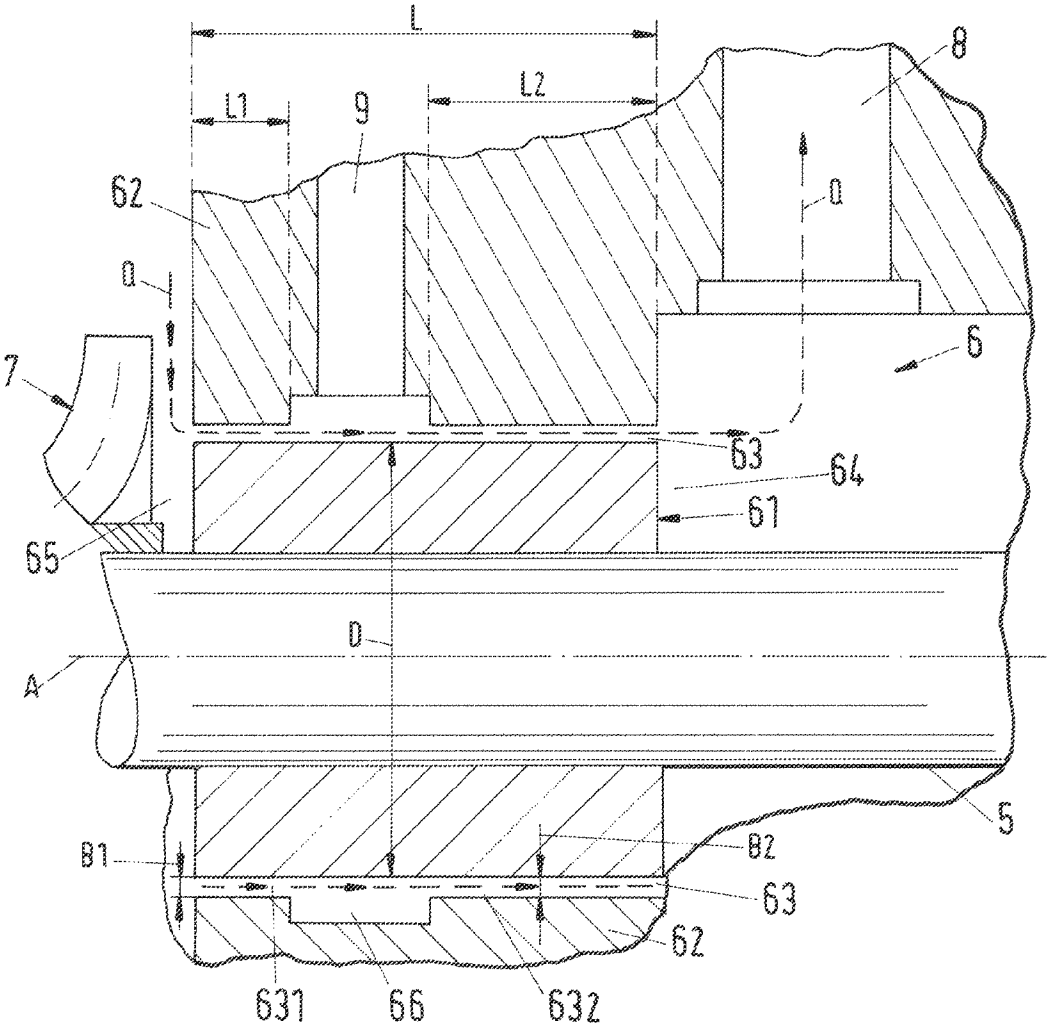
FIG. 2 is an enlarged sectional illustration of the balance drum of the first embodiment in a first operating state.

In a schematic illustration of a first embodiment FIG. 1 shows a pump in accordance with the invention that is referred to in totality with the reference numeral 1 and is configured as a rotary pump and/or as a centrifugal pump. In FIG. 1 a few parts of the pump 1 are shown as an outcrop. FIG. 2 shows a few parts of the pump 1 in an enlarged sectional illustration.

The pump 1 has a housing 2 having an inlet 3 through which a fluid to be conveyed can be introduced into the pump 1, as is symbolized by the arrow E in FIG. 1. Furthermore, the housing 2 has an outlet 4 through which the fluid to be conveyed leaves the pump 1, as is symbolized by the arrow O in FIG. 1. Moreover, the pump has a rotatable shaft 5 whose longitudinal axis A defines an axial direction. In the following always the direction of the longitudinal axis A of the shaft 5 is thus meant when reference is made to the axial direction. The radial direction then being meant as the direction standing perpendicular to the axial direction.

At least one impeller 7 for conveying the fluid is provided at the shaft 5 of which only the upper half is illustrated in FIG. 2. The pump 1 in accordance with the invention can be configured both as a single stage pump having only one impeller 7 and also as a multi-stage pump having at least two impellers 7 that are arranged axially spaced apart behind one another at the shaft 5 in a manner known per se. When reference is made to the impeller 7 either the single impeller of a single stage pump is meant or the last impeller 7 of a multi-stage pump is meant in the following which is that impeller 7 which generates the highest pressure. Preferably the pump 1 in accordance with the invention is configured as a multi-stage centrifugal pump.

Furthermore, the pump 1 in accordance with the invention can be configured as a single phase pump or as a multi-phase pump. Multi-phase pumps are configured for the conveyance of multi-phase fluids, this means they can convey fluids that include a mixture of a plurality of phases, for example, one or more liquid phases, e.g. in the form of an emulsion and one or more gaseous phases. Preferably, the pump 1 in accordance with the invention is configured as a multi-phase pump.

The pump in accordance with the invention is preferably a pump 1 for the conveyance of highly viscous fluids, such as, for example, oil or crude oil. Highly viscous fluids in the frame work of this application are such fluids whose dynamic viscosity amounts to at least 65 cP (centipoise) which in SI units corresponds to 0.065 Pa s (pascal seconds).

In the following reference will be made with exemplary character to the case of application important for practice in which the pump in accordance with the invention is used in the conveyance of oil and gas, for example as a conveying pump with which the oil or the oil-gas-mixture is conveyed out of the bore hole of an oil field or as a transport pump with which the oil and/or the oil-gas-mixture is conveyed through a pipeline. In particular the pump in accordance with the invention can be configured as a sub-sea pump that, for example, is operated in the sub-sea conveyance of oil and gas at the bed of the sea. However, it is understood that the invention is not limited to such designs and applications.

The first embodiment of the pump 1 in accordance with the invention (see FIG. 1 and FIG. 2) has a balance drum 6 for the relief of axial thrust. A force is generated in the axial direction by means of the balance drum 6 which is directed opposite to the axially hydraulic force that is generated by the impellers 7 on a conveyance of the fluid.

The balance drum 6 has a substantially cylindrical rotor 61 that is rotationally fixedly connected to the shaft 5, as well as a stator 62 stationary with respect to the housing 2. The stator 62 can, for example be configured as a cylindrical sleeve that is fixedly connected to the housing 2 or the stator 62 could form parts of the housing itself. The rotor 61 has a diameter D. It has a high pressure side 65 and a low pressure side 64. The end surface at the high pressure side 65 of the rotor 61 is impinged on with a high pressure. This typically occurs in that one applies a pressurized fluid at the high pressure side 65 of the rotor 61 behind the impeller 7 or behind the last impeller 7 respectively. The high pressure side 65 is then substantially impinged with that pressure which the fluid has at the outlet 4 of the pump 1. The low pressure side 64 is impinged with a significantly reduced pressure, typically the pressure which the liquid has at the inlet 3 of the pump. This can, for example, be realized in such a way that the low pressure side 64 of the rotor 61 is connected to the inlet 3 of the pump via a return passage 8 in a flow communicating manner.

The diameter D of the rotor 61 and the internal diameter of the cylindrical stator 62 are dimensioned in such a way that a ring-shaped relief passage 63 is configured between the jacket surface of the rotor 61 and the internal jacket surface of the stator 62, with the ring-shaped relief passage extending between the rotor 61 and the stator 62 from the high pressure side 65 in the axial direction up to the low pressure side 64. The width B1 and/or B2 of the relief passage 63 in the radial direction in this connection corresponds to the difference between the internal diameter of the stator 62 and the diameter D of the rotor.

The leakage flow Q through the relief passage 63 amongst other things causes the following three effects:

Firstly the leakage flow Q means a volume loss of the fluid to be conveyed by the pump. For this reason it is desirable that the leakage losses do not become too large.

Secondly—and this is in particular true having regard to highly viscous fluids—the fluid generates heat to a considerable degree on a through-flow through the relief passage 63 by means of adhesion and/or friction, in particular at the stator 62 and at the rotor 61, that can lead to significant temperature increases in the relief gap 63 and/or in its surrounding components. These temperature increases can be so strong, having regard to highly viscous fluids of e.g. 100° C. and more, that the plant can no longer be operated safely and/or that can lead to damages at the components of the pump 1.

Thirdly, besides the relief of axial thrust—it brings about forces due to the Lomakin effect by the leakage flow Q flowing through the relief passage 63 which center the shaft 5, stabilize the shaft and dampen oscillations of the shaft. This effect is thus positive on the damping and the stiffness of the shaft bearing.

The leakage flow Q and its effects depend on very many parameters, on the one hand, on the geometric dimensions of the balance drum 6 which for a predefined internal diameter of the stator 62 are primarily the diameter D of the rotor 61 that determines the width B1, B2 of the relief passage 63, as well as the length L of the rotor 61 in the axial direction which determines the axial length of the relief passage 63. These parameters must be predefined having regard to the design of the pump 1 for its later use that frequently stands for an operating duration of several years and can then later only be changed by an exchange of the hydraulic components of the pump 1.

The leakage flow Q also depends on the pressure difference that decreases over the rotor 61, on the number of rotations, this means on the rotational speed of the pump 1 and naturally on the properties of the fluid to be conveyed, such as its density or its viscosity.

For this reason one strives to consider all of these effects on the design of the pump 1 and to configure the pump in such a way that this can be operated over many years for the respective case of application possibly without the exchange of hydraulic components.

Such that the pump 1 is suitable, in particular for the continuous conveyance of a fluid with strongly varying viscosity it is suggested in accordance with the invention to provide at least one intermediate passage 9 which opens into the relief passage between the high pressure side 65 and the low pressure side 64 of the rotor 61, and to provide a blocking member 10 (see FIG. 1) for the influencing of the flow through the intermediate passage 9.

By this measure the length of the relief gap 63 can be varied, whereby a particularly good adaptability with respect to variations in the viscosity of the fluid results.

Having regard to the first embodiment of the pump 1 described in this example, the relief passage 63 comprises a ring space 66 which surrounds the shaft 5 and into which the intermediate passage 9 opens. The ring space 66 in a radial direction has a width that is larger than the width B1, B2 of the relief passage 63. Outside of the ring space 66 the relief passage 63 has a constant width B1 or B2 respectively in the radial direction when viewed over its axial length. Naturally also designs are possible in which these widths B1 or B2 vary.

The intermediate passage is, as is illustrated in FIG. 1, connected to the inlet 3 of the pump. The blocking member 10 is configured at least as an open-closed-valve which in a first position completely blocks the flow connection through the intermediate passage 9 to the inlet 3 and which, in a second position, completely opens the flow connection through the intermediate passage 9.

Figure 3:
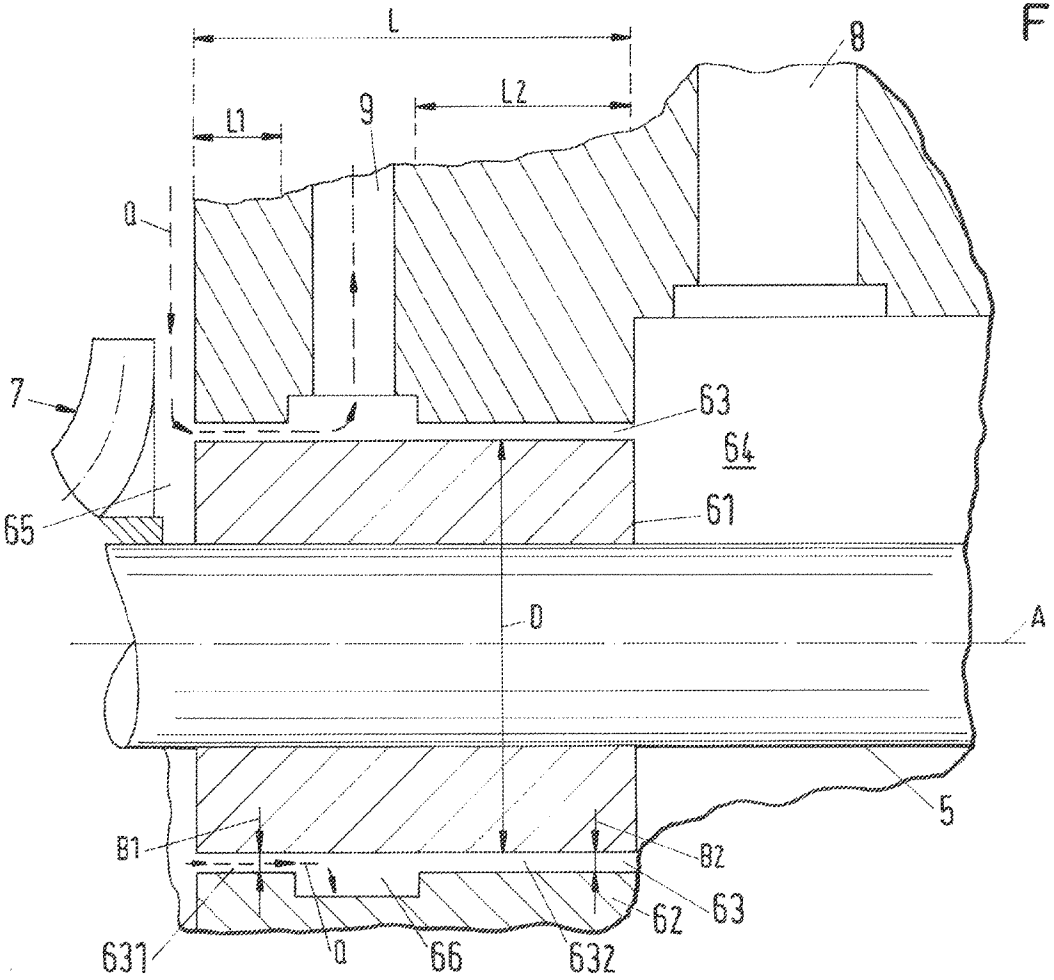
FIG. 3 is an enlarged sectional illustration of the balance drum of the first embodiment in a second operating state.

FIG. 2 shows the first embodiment of the pump 1 in a first operating state in which the blocking member 10 is present in the first position, this means the flow connection through the intermediate passage 9 is closed, whereas FIG. 3 shows the first embodiment of the pump 1 in a second operating state in which the blocking member 10 is in the second position, this means the flow connection through these intermediate passage 9 is completely open.

Preferably the blocking member 10 is configured as a settable through-flow valve 10 with which the leakage flow Q through the intermediate passage 9 can be set to values also between zero and the maximum through-flow.

Both the return passage 8 as well as the intermediate passage 9 are respectively configured in such a way in particular having regard to their diameter, that they have at least no substantial throttle effect on the leakage flow Q, this means that the respective flow resistance of the return passage 8 and of the intermediate passage 9 is dimensioned in such a way that it is substantially smaller than the flow resistance of the relief passage 63. Thereby it can be ensured that the complete pressure difference essentially decreases over the rotor 61 and thus in this way generates an as large as possible relief of axial thrust.

In the following the function of the pump 1 and in particular the adaptation to the varying viscosity of the fluid will be described with respect to the example of extraction of an oil field with the pump 1.

At the start of the extraction of an oil field this is still pressurized at its original natural pressure and the oil or the oil-gas-mixture respectively can frequently be conveyed without additional measures by means of the pump 1. A typical value for the viscosity of the oil in this phase amounts to, for example, 100-200 cP.

In this phase the pump 1 is operated in the first operating state illustrated in FIG. 2. The flow connection through the intermediate passage 9 for the leakage flow Q is blocked by the blocking member 10. The relief passage 63 that has the overall length L in the axial direction is, now when viewed from a flow technological point of view, the series connection of a first part passage 631 of the axial length L1 which extends from the high pressure side up to the start of the ring space 66 and has a radial width B1, as well as of a second part passage 632 of the axial length L2 which extends, when viewed in the flow direction, from the axial end of the ring space 66 up to the low pressure side 64 and has a radial width B2. The effective length of the relief passage 63 is thus the sum of L1+L2, with L1+L2 naturally being smaller than the overall length L. The leakage flow Q thus completely flows from the high pressure side 65 through the relief passage 63 to the low pressure side 64 and from their through the return passage 8 back to the inlet 3 of the pump.

The width B1 of the first part passage 631 in radial direction and the width B2 of the second part passage 632 in the radial direction are preferably respectively constant over the axial length L1 of the first part passage or L2 of the second part passage respectively. In this connection the width B1 and B2 can be equal or different from one another. If one designs the width B1 and B2 different from one another then the possibility of varying the width of the relief passage additional results, whereby one now has a further parameter for influencing the leakage flow Q at ones disposal.

Different widths B1 and B2 can, for example, be realized thereby that the rotor 61 has a different diameter D in the region in which it forms the first part passage 631 than in the region in which it forms the second part passage 632. Naturally it is also possible to design the diameter D of the rotor 61 as constant over its complete axial length L and to design the stator 62 in the region of the first part passage 631 with a different internal diameter than in the region of the second part passage 632. Furthermore, a combination of the two measures is possible, this means to design both the internal diameter of the stator 62 as well as the diameter D of the rotor as different over the respective axial length L.

As was described in the foregoing, the natural pressure in the oil field decreases on a progressive extraction of the oil field and one starts, to press, for example, water into the oil field in order to thereby again increase the pressure in the oil field or to compensate the pressure decrease respectively. Due to this injection of water the formation of an emulsion of water and oil becomes ever more strong with an increase in time and this emulsion now has to be conveyed by the pump 1. The formation of the emulsion can be associated with a drastic increase of the internal friction and/or of the viscosity that can lie in the range of orders of magnitudes. This peak in the viscosity in the timely progression on the extraction of the oil field is known and it can, for example, only emerge after a few years of the extraction.

When now the viscosity of the fluid increases starkly then this, on the one hand, leads to a reduction of the leakage flow Q, but, on the other hand, to a drastic increase of the heat generated in the relief gap 63 and in this way to a significant temperature increase. In order to avoid this temperature increase the pump is now switched into the second operating state that is illustrated in FIG. 3.

The blocking member 10 is now brought into the position in which it completely opens the flow connection through the intermediate passage 9 for the leakage flow Q. As the intermediate passage 9 now represents the significantly reduced resistance for the leakage flow Q than the second part passage 632 of the relief passage 63, the predominant portion of the leakage flow Q flows from the high pressure side 65 through the first part passage 631 of the length L1 into the ring space 66 and from there through the intermediate passage 9 to the inlet 3 of the pump 1. In this way the effective length of the relief passage 63 now only has the length L1 of the first part passage 631 and in this way is significantly shorter than in the first operating state. Hereby it can be achieved that the leakage rate is increased and the heat generated in the release passage 63 becomes considerably smaller and in this way also the resulting temperature increase becomes smaller. If, additionally, the first part passage 631 is configured with a larger radial width B1 than the second part passage 632 then the effective width of the relief passage 63 also increases, whereby the leakage flow Q can additionally be increased.

During the further extraction of the oil field, the water portion in the conveyed fluid becomes ever larger, whereby the viscosity drastically decreases again after passing through the maximum brought about through the formation of the emulsion. Now the pump 1 can be brought back into the first operating state through a closure of the blocking member 10 that is illustrated in FIG. 2.

The suitable selection of the ratios of the lengths L1 to L2 and/or L1 to L or L2 to L, as well as of the widths B1 and/or B2 in the radial direction depends on the respective case of application. Typically calculations with regard to the long time running behavior of the extraction are generated prior to the extraction of a new oil field. For example, a suitable value for L, L1, L2, as well as for the widths B1, B2 of the relief passage 63 and/or the diameter D of the rotor 61 can be determined by such calculations with the aid of model calculations or simulations.

It is understood that deviating from the illustration in FIG. 1 also designs are possible in which the intermediate passage 9 opens into the return passage 8 downstream of the blocking member 10.

Figure 4:
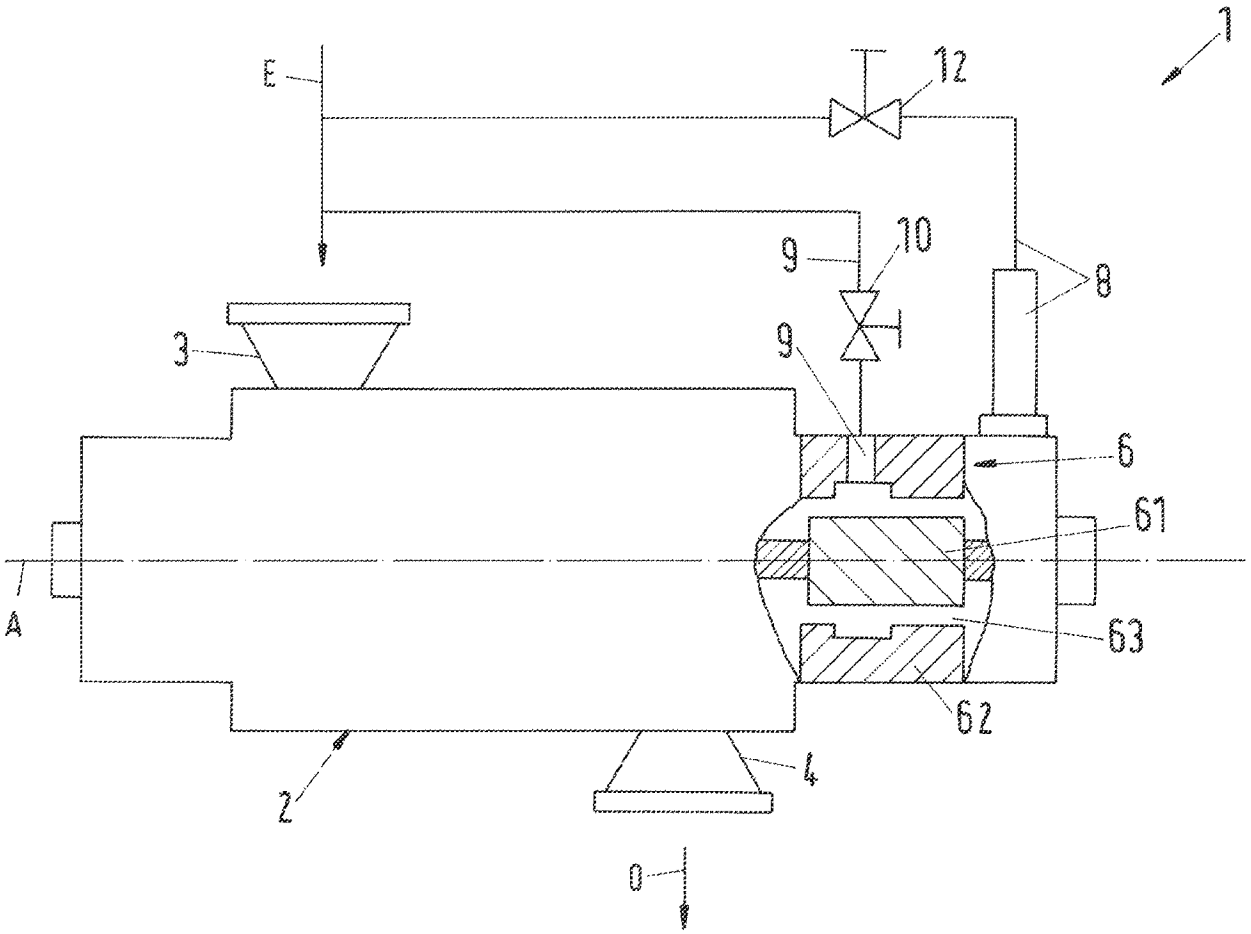
FIG. 4 is like FIG. 1, however, for a first variant.

FIG. 4 shows a first variant for the embodiment of the pump 1. Having regard to this variant a second blocking member 12 is provided for the influencing of the flow through the return passage 8. The blocking member 12 can also be configured as an open-closed-valve 12 or as a settable through-flow valve by means of which the leakage flow Q through the return passage 8 can be set.

Figure 5:
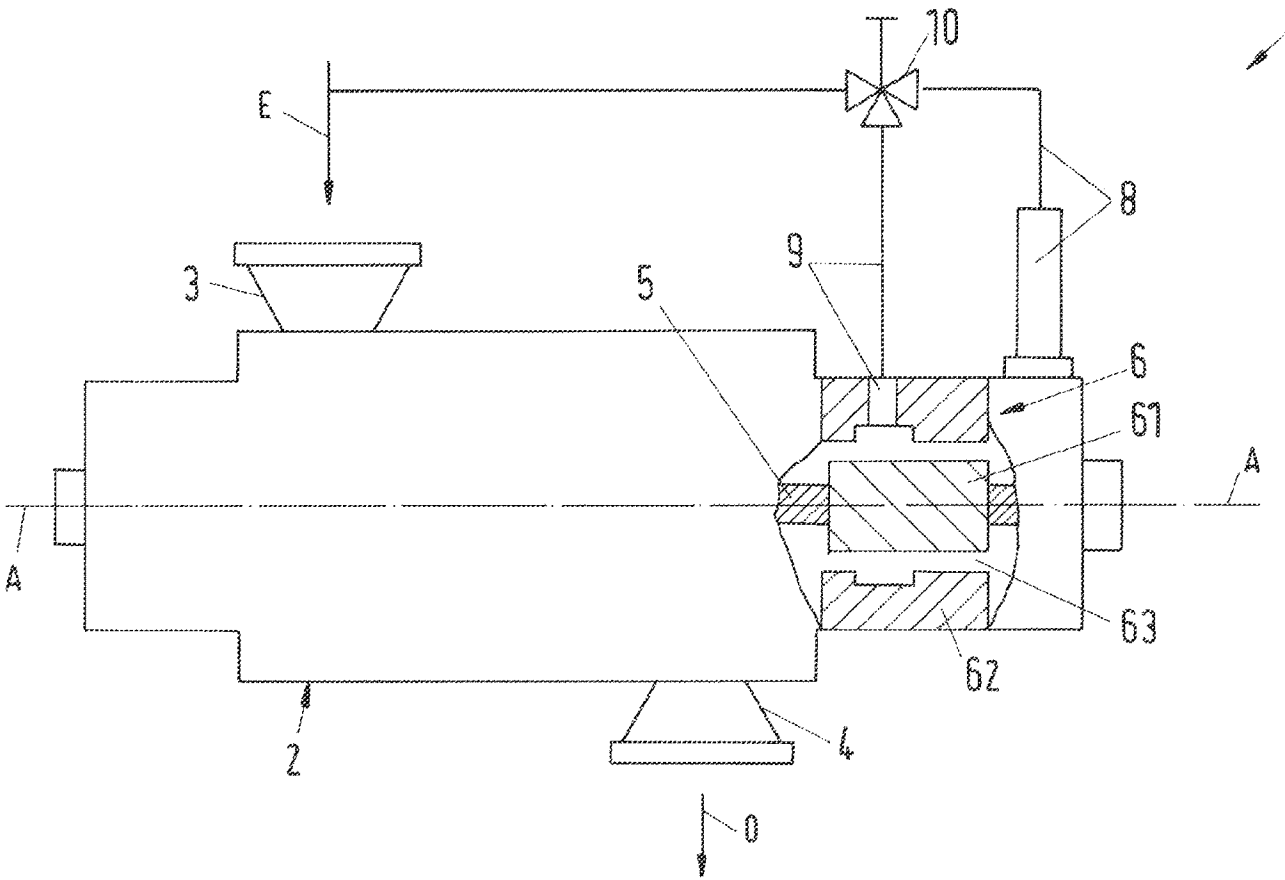
FIG. 5 is like FIG. 1, however, for a second variant.

FIG. 5 shows a second variant for the embodiment of the pump 1. Having regard to the second variant the intermediate passage 9 opens into the return passage 8. The blocking member 10 is disposed at this opening, wherein this blocking member is configured as a three-way valve 10 which is connected to the inlet 3, to the return passage 8 and to the intermediate passage 9 in a flow communicating manner. In order to realize the first operating state (FIG. 2) the three-way valve 10 is switched in such a way that it connects the return passage 8 to the inlet 3, such that the leakage flow Q can flow through the return passage 8 to the inlet 3. In this position the intermediate passage 9 is blocked such that no leakage flow Q can flow away through it. In order to realize the second operating state (FIG. 3) the three-way valve 10 is switched in such a way that it connects the intermediate passage 9 to the inlet 3 such that the leakage flow Q can flow from the ring space 66 through the intermediate passage 9 to the inlet 3. In this position the return passage 8 is blocked such that no leakage flow Q can flow away through it.

Figure 6:
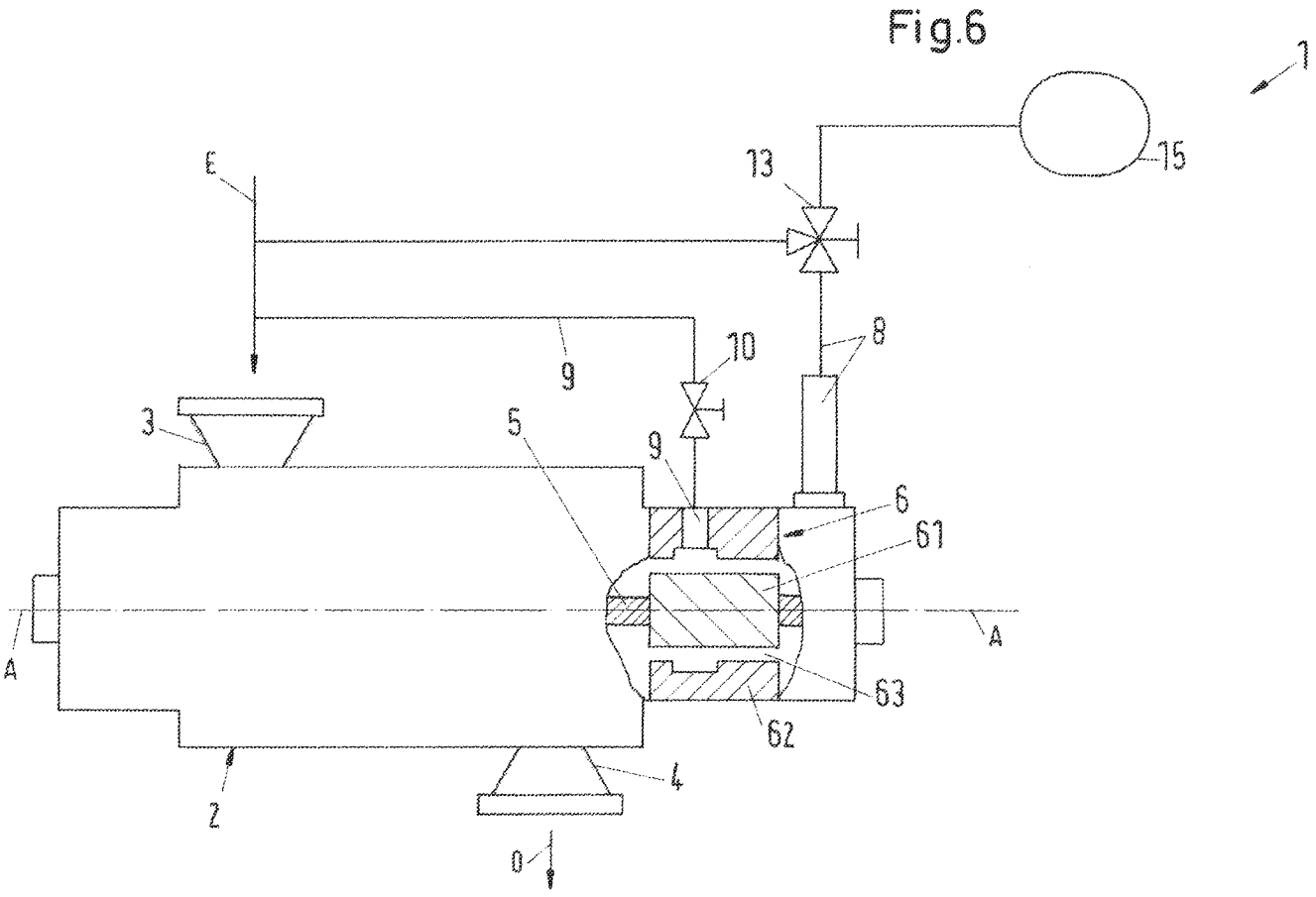
FIG. 6 is like FIG. 1, however, for a third variant.

FIG. 6 exemplifies a third variant of the embodiment of the pump 1. Having regard to this third variant a switching member 13 is provided in the return passage 8 by which the return passage 8 can be selectively connected to the inlet 3 of the pump 1 or to a source 15 for a second fluid, such that the second fluid can be supplied through the return passage 8 to the low pressure side 64 of the rotor.

Figure 7:
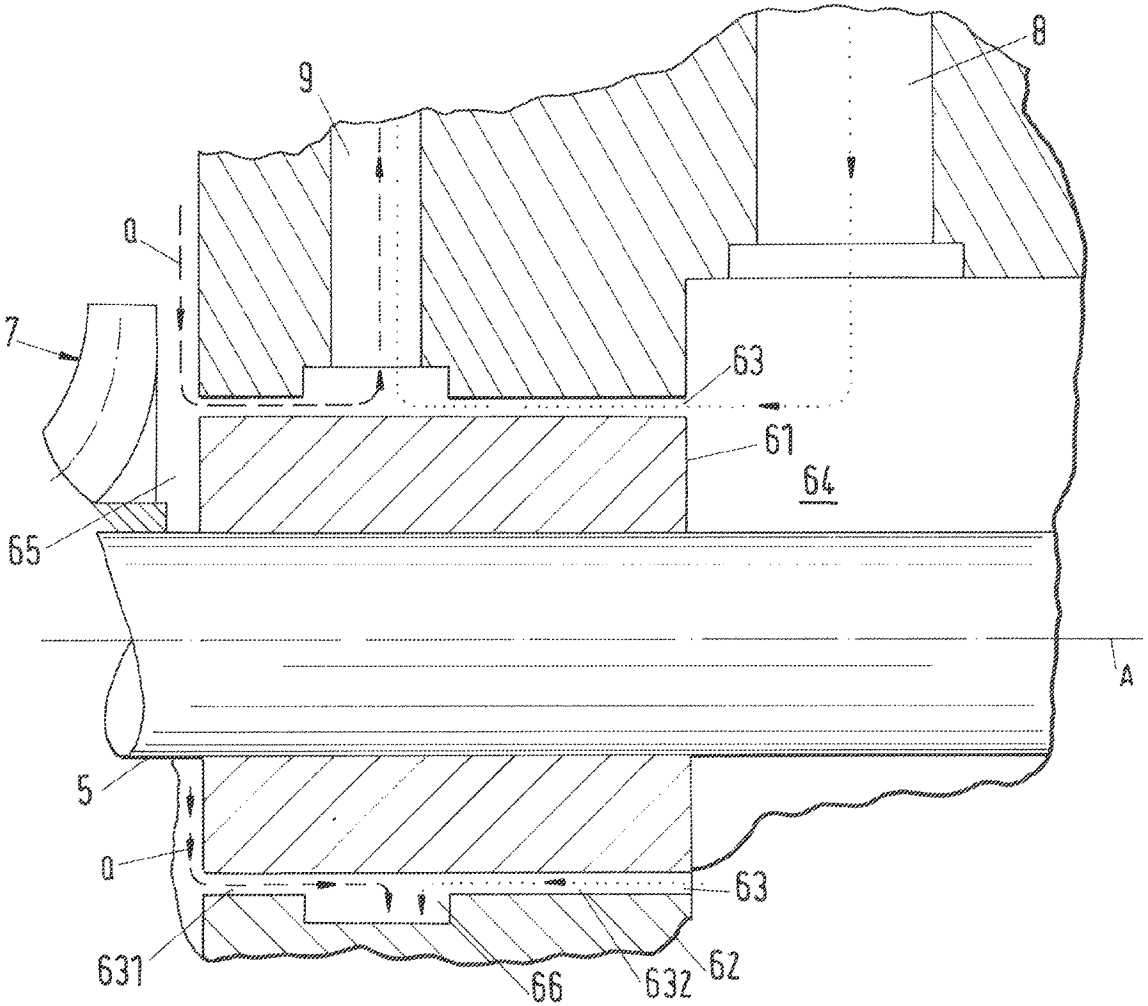
FIG. 7 is an enlarged sectional illustration of the balance drum in an operating state of the third variant of FIG. 6.

In an illustration analog to FIG. 2 and/or FIG. 3, FIG. 7 shows an operating state of the third variant of FIG. 6. In this operating state the switching member 13 is set in such a way that it connects the return passage 8 to the source 15 for the second fluid and the flow connection to the inlet 3 of the pump 1 is blocked. The second fluid is, for example, a blocking liquid, such as water or a different suitable medium or a cooling fluid, by which a counter-pressure can be produced in the second part passage 632 of the relief passage 63. In FIG. 7 the flow of the second fluid is illustrated with dotted lines provided with arrows. The second fluid flows through the return passage 8 to the low pressure side 64 of the rotor and from there through the second part passage 632 of the relief passage 63 towards the leakage flow Q. In the region of the ring space 66 the two fluids combine again and are commonly dispensed through the intermediate passage. The second fluid can, for example, be used for the purpose of generating a counter pressure in the relief passage 63 in order to reduce the flow rate of the leakage flow Q or to conduct away heat from the relief gap 63.

Figure 8:
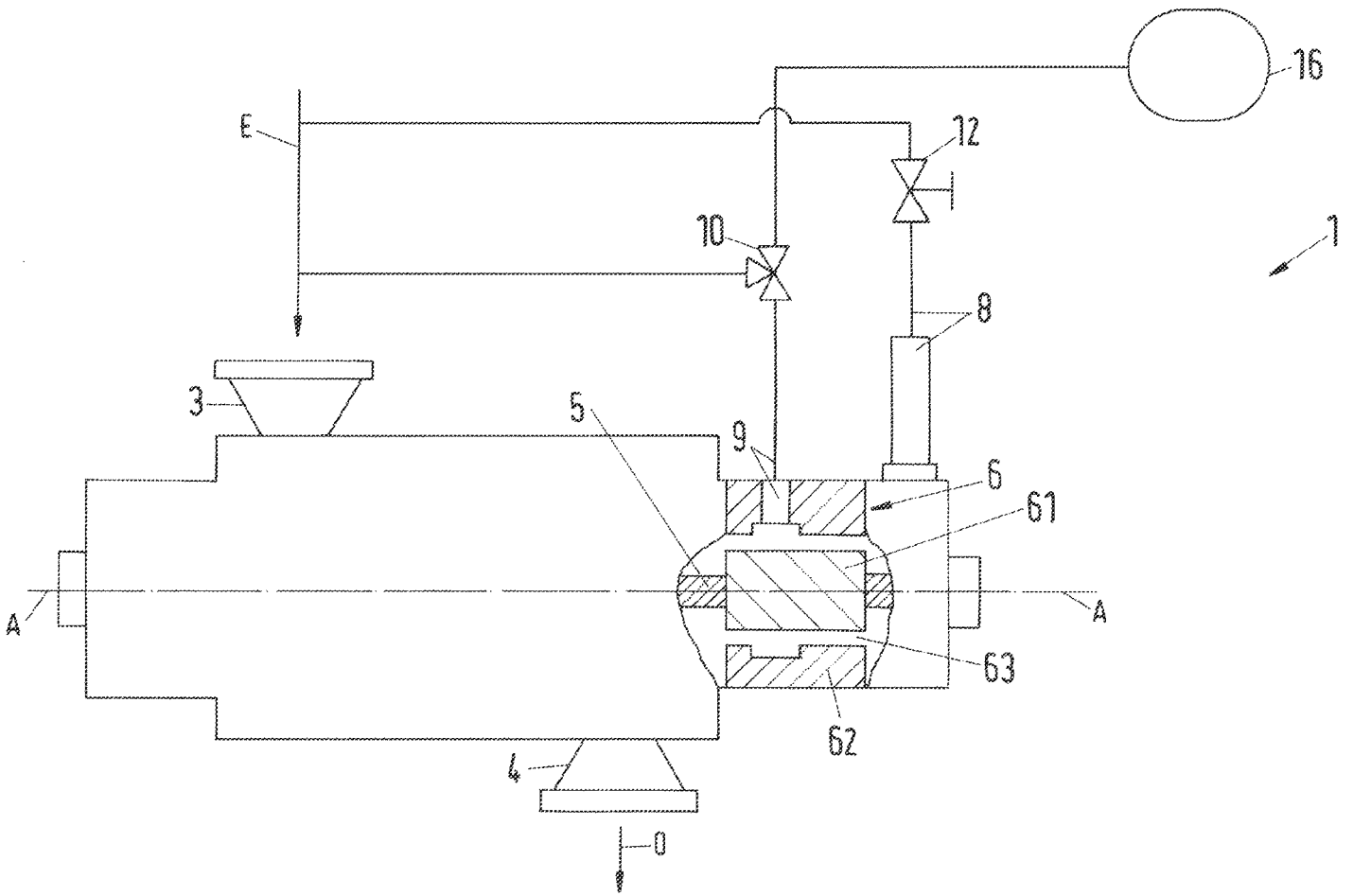
FIG. 8 is like FIG. 1, however, for a fourth variant.

FIG. 8 shows a fourth variant of the embodiment of the pump 1. Having regard to this fourth variant a blocking member 10 is arranged and configured in such a way that the intermediate passage 9 can be connected to a source 16 for a second fluid, such that the second fluid can be introduced into the relief passage 63 through the intermediate passage. Preferably the blocking member 10 is configured as a three-way valve 10 in this example which selectively connects the intermediate passage 9 to the inlet 3 of the pump 1 or to the source of the second fluid.

Figure 9:
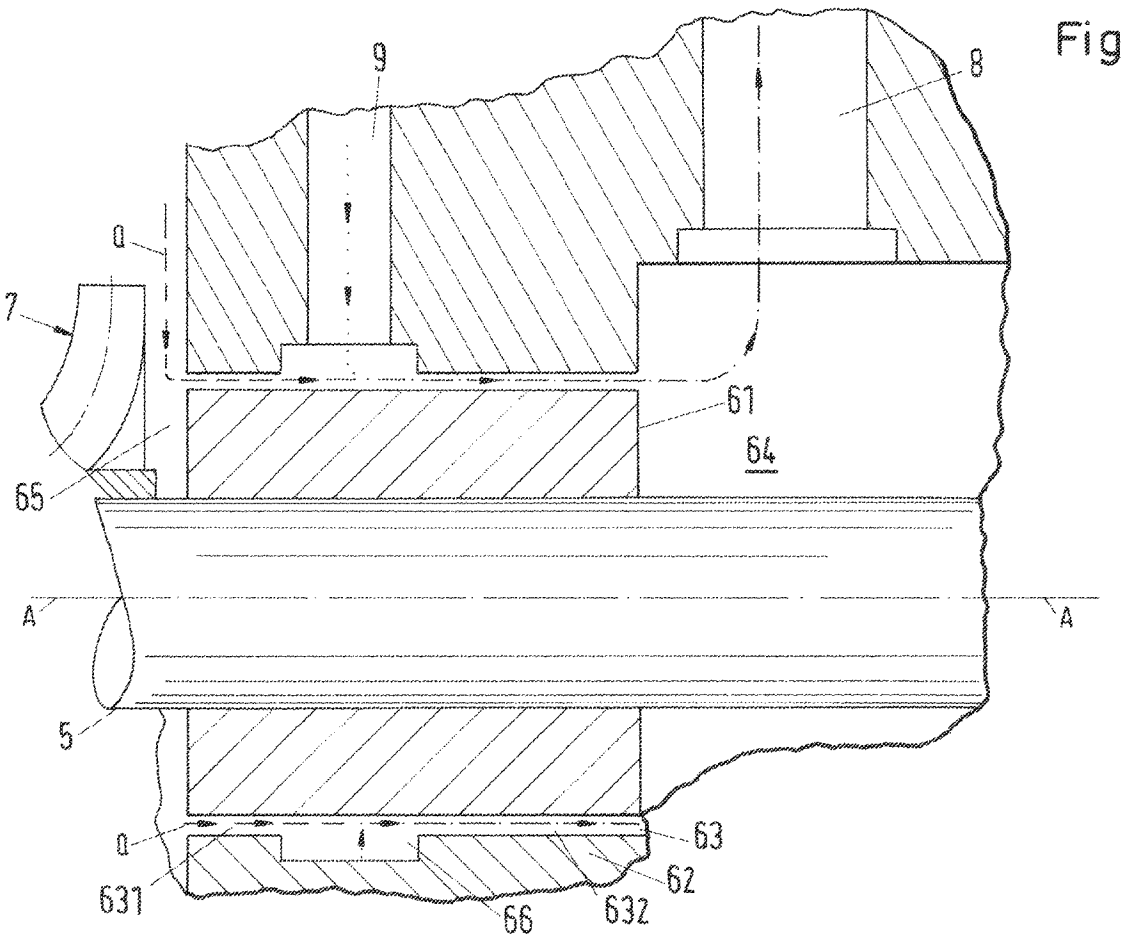
FIG. 9 is an enlarged sectional illustration of the balance drum in an operating state of the fourth variant of FIG. 8.

In an illustration analog to FIG. 2 and/or FIG. 3, FIG. 9 shows an operating state of the fourth variant of FIG. 8. In this operating state the three-way valve 10 is set in such a way that it connects the intermediate passage 9 to the source 16 for the second fluid and the flow connection to the inlet 3 of the pump 1 is blocked. The second fluid is, for example, a demulsifier with which the viscosity of the leakage flow Q can be reduced, or water for thinning the leakage flow Q, or a cooling fluid with which heat can be conducted away from the relief gap 63, in FIG. 9 the flow of the second fluid is illustrated with dotted lines provided with arrows. The second fluid flows through the intermediate passage 9 into the ring space 66 and flows together with this through the second part passage 632 of the release passage 63 to the low pressure side 64. From there the leakage flow Q is commonly conducted away together with the second fluid through the return passage 8.

It is understood that the four variants described in this connection and/or the measures mentioned can be combined with one another in an arbitrary manner.

Figure 10:
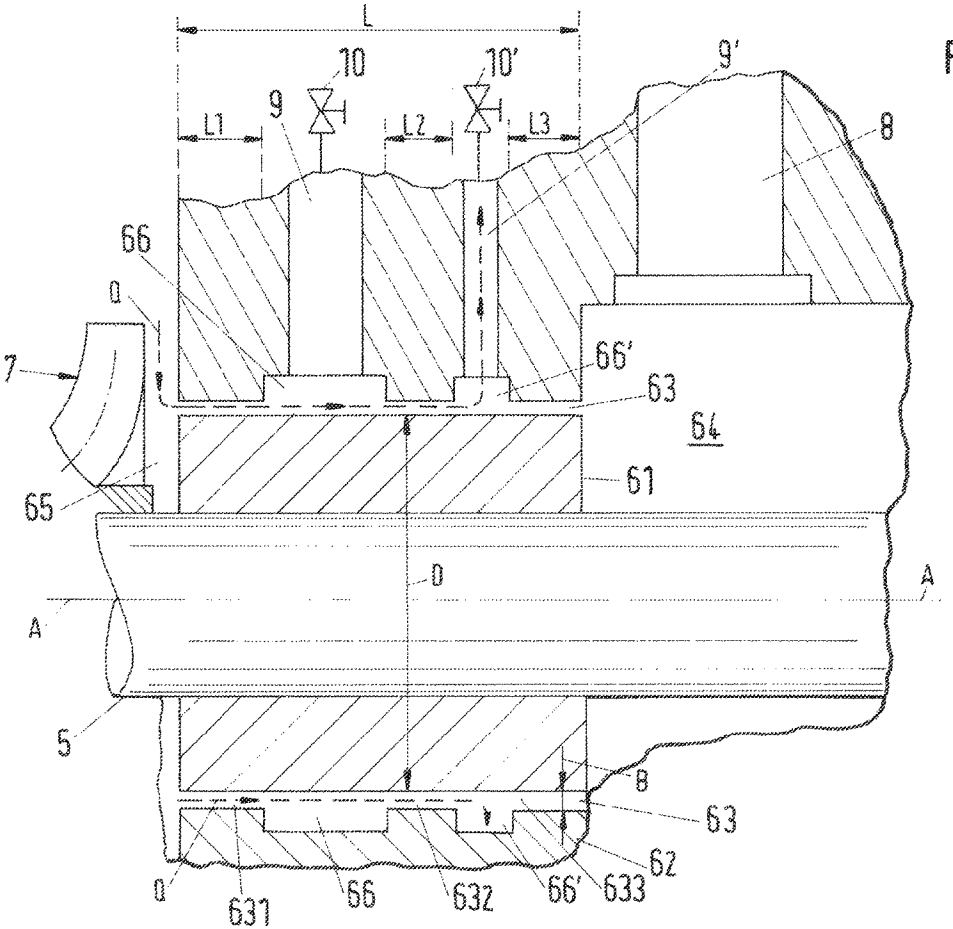
FIG. 10 is like FIG. 2, however, for a second embodiment of a pump in accordance with the invention.

FIG. 10 is an illustration analog to FIG. 2 that shows a second embodiment of a pump 1 in accordance with the invention. In the following reference will only be made to the differences to the first embodiment. The reference numerals have the same meaning as was already explained in connection with the first embodiment.

The explanations made with respect to the first embodiment and all of its variant are true in a like or analog-like manner also for the second embodiment.

Having regard to the second embodiment of the pump 1 in accordance with the invention, a second intermediate passage 9' is still provided that likewise opens into the relief passage 63 between the high pressure side 65 and the low pressure side 64. A further blocking member 10' is provided for this second intermediate passage 9' by which the leakage flow Q in the second intermediate passage 9' can be influenced. In particular the second intermediate passage 9' can be blocked by the further blocking member 10' such that no leakage flow Q can flow through it and the second intermediate passage 9' can be connected to the inlet 3 of the pump 1 in a flow communicating manner by the further blocking member 10' such that the leakage flow Q can flow away to the inlet of the pump 1 through the second intermediate passage 9'.

Furthermore the relief passage 63 has a second ring space 66' which surrounds the shaft and into which the second intermediate passage 9' opens.

Having regard to this design having the two intermediate passages 9, 9' the relief passage 63, from a flow technology point of view, corresponds to the series connection of three part passages, namely a first part passage 631 of the axial length L1 that extends from the high pressure side 65 up to the start of the ring space 66, a second part passage 632 of the axial length L2 that extends from the end of the ring space 66 to the start of the second ring space 66' and a third part passage 633 of the axial length L3 that extends from the end of the second ring space 66' up to the low pressure side 64 of the rotor 61.

The respective width B of the part passages 631, 632, 633 is only referred to with B in FIG. 10 in summary for reasons of clarity. It is understood that in an analog-like manner to the first embodiment each part passage 631, 632, 633 can have a different width in the radial direction or that the same width is selected in the radial direction for two of the part passages and for the remaining part passage 631 or 632 or 633 one selects a width deviating therefrom. Naturally, the same width B can be selected in the radial direction for all three part passages 631, 632, 633. Within a part passage the width B is preferably constant, can however also vary.

With this design a total of three relief passages of different length can be realized in the operating state. If one now lets the leakage flow Q flow away through the return passage 8 then the effective length of the relief passage 63 in the axial direction is L1+L2+L3, with this effective length naturally being smaller than the overall length L.

If one lets the leakage flow Q flow away through the second intermediate passage 9', as is illustrated in FIG. 10, then the effective length of the relief passage 63 is L1+L2 in the axial direction.

If one lets the leakage flow Q flow away through the first intermediate passage 9 then the effective length of the relief passage 63 is now only L1.

In this way a plurality of relief passages 63 can thus be realized that all have different length in the axial direction and moreover can have different widths B in the radial direction.

Naturally also in this example the intermediate passages 9, 9' or the return passage 8 can be used for the supply of a second fluid.

It is understood that also more than two intermediate passages 9, 9' can be provided that respectively open into the relief passage 63 in an analog-like manner.

Having regard to the pump 1 in accordance with the invention it is also possible to compose the rotor 61 and/or the stator 62 of a plurality of parts. Thus it is no way necessary that the rotor 61 or the stator 62 is of one-piece design. Furthermore, it is possible to configure the rotor 61 or the stator 62 in such a way that the relief gap 63 also has no constant width B1, B2, B outside of the ring space 66, 66' but rather tapers or widens when viewed, for example in the axial direction. Furthermore, it is possible to coat or to structurize the jacket surface of the rotor 61 or the internal jacket surface of the stator 62. Furthermore, it is possible to provide one or more swirl brakes at the high pressure side 65 in the region of the inlet into the relief passage 63 and/or in the relief passages 63 for example, at the inlets into the respective part passages 631, 632, 633, by which flows of the fluid can be deflected in the circumferential direction around the shaft 5 into the axial direction.

The blocking member 10, 10' and the second blocking member 12 can be configured as open-closed-valves with which the flow through the respective passage is either completely released or completely blocked. However, it is also possible that the blocking member 10, 10' or the second blocking member 12 is configured as a settable through-flow valve by means of which the flow into the respective passage can be set to an arbitrary value between zero and a maximum value.

The blocking member 10, 10' or the second blocking member 12 or the switching member 13 can be configured in such a way that they can be operated by means of remote control, for example having regard to sub-sea applications by a signal line via which a preferably electrical or hydraulic signal is conducted which switches and/or regulates the respective blocking member or switching member in the respective desired state. The capability of being remote controlled can also be configured free of signal lines.

Naturally such designs of the blocking members 10, 10', 12 or of the switching members 13 are possible in which the respective member 10, 10', 12 and/or 13 is manually actuated, this means by hand. Having regard to sub-sea applications this manual setting can also be carried out with the aid of diving robots.

The invention claimed is:

1. A pump for conveying a fluid with varying viscosity, comprising:

a housing having an inlet and an outlet configured to convey the fluid;

an impeller configured to convey the fluid from the inlet to the outlet, the impeller being arranged on a rotatable shaft; and a balance drum configured to relieve axial thrust, the balance drum comprising a rotor rotationally fixedly connected to the shaft, the rotor having a high pressure side and a low pressure side, a stator configured to be stationary with respect to the housing, and a relief passage extending between the rotors and the stator from the high pressure side up to the low pressure side of the rotor;

a return passage connecting the low pressure side of the rotor to the inlet;

an intermediate passage opening into the relief passage between the high pressure side and the low pressure side of the rotor; and a blocking member configured to influence the flow through the intermediate passage.

2. The pump according to claim 1, wherein the relief passage comprises a ring space surrounding the shaft and into which the intermediate passage opens.

3. The pump according to claim 2, wherein the relief passage has a constant width in a radial direction outside of the ring space in a first part passage of the relief passage or in a second part passage of the relief passage.

4. The pump according to claim 1, wherein the intermediate passage is connected to the inlet.

5. The pump according to claim 1, wherein the intermediate passage opens into the return passage.

6. The pump according to claim 1, wherein the blocking member is a settable through-flow valve.

7. The pump according to claim 1, further comprising a second blocking member configured to influence the flow through the return passage.

8. The pump according to claim 1, wherein the blocking member is a three-way valve connected to the inlet, to the return passage and to the intermediate passage in a flow communicating manner.

9. The pump according to claim 1, further comprising a switching member configured to selectively connect the return passage to the inlet of the pump or to a source for a second fluid, such that the second fluid can be supplied to the low pressure side of the rotor through the return passage.

10. The pump according to claim 1, wherein the blocking member is arranged and configured such that the intermediate passage is capable of being connected to a source for a second fluid such that the second fluid is capable of being introduced into the relief passage through the intermediate passage.

11. The pump according to claim 1, wherein the intermediate passage is one of a plurality of intermediate passages each intermediate passage opening into the relief passage between the high pressure side and the low pressure side.

12. The pump according to claim 1, wherein at least one of the blocking member or a second blocking member or a switching member are configured to be operated in a remote controlled manner.

13. The pump according to claim 1, wherein the pump is a multi-stage pump having at least one second impeller arranged at the shaft, and being configured to convey the fluid.

14. The pump according to claim 1, wherein the pump is a multi-phase pump.

15. The pump according to claim 1, wherein the pump is a centrifugal pump configured to convey oil and gas.

16. The pump according to claim 15, wherein the pump is a subsea pump configured to subsea convey the oil and the gas.

* * * * *